US005429909A

United States Patent [19]

Kaszczuk et al.

[11] Patent Number: 5,429,909

[45] Date of Patent: Jul. 4, 1995

[54] OVERCOAT LAYER FOR LASER ABLATIVE IMAGING

[75] Inventors: Linda Kaszczuk; Lee W. Tutt; Sharon W. Weber, all of Webster, N.Y.

[73] Assignee: Eastman Kodak Company, Rochester, N.Y.

[21] Appl. No.: 283,880

[22] Filed: Aug. 1, 1994

[51] Int. Cl.[6] ..... G03C 1/73; G03C 1/76

[52] U.S. Cl. ..... 430/273; 430/201; 430/322; 430/944; 430/961; 430/964; 346/135.1

[58] Field of Search ..... 430/200, 201, 273, 944, 430/961, 964, 322; 346/135.1

[56] References Cited

U.S. PATENT DOCUMENTS

| | | | |
|---|---|---|---|
| Re. 32,039 | 11/1985 | Hollister et al. | 430/961 |
| 3,962,513 | 6/1976 | Eames | 430/201 |
| 4,626,493 | 12/1986 | Butters et al. | 430/464 |
| 4,656,121 | 4/1987 | Sato et al. | 430/964 |
| 4,711,834 | 12/1987 | Butters et al. | 430/964 |
| 4,752,554 | 6/1988 | Sato et al. | 430/273 |
| 4,758,499 | 7/1988 | Abe et al. | 430/964 |
| 5,156,938 | 10/1992 | Foley et al. | 430/199 |
| 5,171,650 | 12/1992 | Ellis et al. | 430/20 |
| 5,256,506 | 10/1993 | Ellis et al. | 430/201 |
| 5,278,023 | 1/1994 | Bills et al. | 430/201 |
| 5,330,876 | 7/1994 | Kaszczuk et al. | 430/964 |

*Primary Examiner*—Richard L. Schilling
*Attorney, Agent, or Firm*—Harold E. Cole

[57] ABSTRACT

A laser dye-ablative recording element comprising a support having thereon, in order, a dye layer comprising an image dye dispersed in a polymeric binder and a polymeric overcoat which does not contain any image dye, the dye layer having an infrared-absorbing material associated therewith to absorb at a given wavelength of the laser used to expose the element, the image dye is substantially transparent in the infrared region of the electromagnetic spectrum and absorbs in the region of from about 300 to about 700 nm and does not have substantial absorption at the wavelength of the laser used to expose the element.

12 Claims, No Drawings

OVERCOAT LAYER FOR LASER ABLATIVE IMAGING

This invention relates to single-sheet, monocolor elements for laser-induced, dye-ablative imaging and, more particularly, to scratch- and abrasion-resistant overcoats for such elements.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271, the disclosure of which is hereby incorporated by reference.

Another way to thermally obtain a print using the electronic signals described above is to use a laser instead of a thermal printing head. In such a system, the donor sheet includes a material which strongly absorbs at the wavelength of the laser. When the donor is irradiated, this absorbing material converts light energy to thermal energy and transfers the heat to the dye in the immediate vicinity, thereby heating the dye to its vaporization temperature for transfer to the receiver. The absorbing material may be present in a layer beneath the dye and/or it may be admixed with the dye. The laser beam is modulated by electronic signals which are representative of the shape and color of the original image, so that each dye is heated to cause volatilization only in those areas in which its presence is required on the receiver to reconstruct the color of the original object. Further details of this process are found in GB 2,083,726A, the disclosure of which is hereby incorporated by reference.

In one ablative mode of imaging by the action of a laser beam, an element with a dye layer composition comprising an image dye, an infrared-absorbing material, and a binder coated onto a substrate is imaged from the dye side. The energy provided by the laser drives off the image dye at the spot where the laser beam hits the element and leaves the binder behind. In ablative imaging, the laser radiation causes rapid local changes in the imaging layer thereby causing the material to be ejected from the layer. This is distinguishable from other material transfer techniques in that some sort of chemical change (e.g., bond-breaking), rather than a completely physical change (e.g., melting, evaporation or sublimation), causes an almost complete transfer of the image dye rather than a partial transfer. Usefulness of such an ablative element is largely determined by the efficiency at which the imaging dye can be removed on laser exposure. The transmission Dmin value is a quantitative measure of dye clean-out: the lower its value at the recording spot, the more complete is the attained dye removal.

Laser-ablative elements are described in detail in U.S. Ser. No. 99,969, filed Jul. 30, 1993, by Chapman et al., the disclosure of which is hereby incorporated by reference. There is a problem with these elements in that they are subject to physical damage from handling and storage.

U.S. Pat. No. 5,171,650 relates to an ablation-transfer image recording process. In that process, an element is employed which contains a dynamic release layer which absorbs imaging radiation which in turn is overcoated with an ablative carrier overcoat which contains a "contrast imaging material", such as a dye. An image is transferred to a receiver in contiguous registration therewith. However, there is no disclosure in that patent that the process should be conducted in the absence of a receiver, or that there should be an overcoat layer on the element which does not contain an image dye.

It is an object of this invention to provide a laser-ablative element which has improved protection from physical damage as it may be caused by handling and storage. It is another object of this invention to provide an ablative single-sheet process which does not require a separate receiving element.

These and other objectives are achieved in accordance with the invention which relates to a laser dye-ablative recording element comprising a support having thereon, in order, a dye layer comprising an image dye dispersed in a polymeric binder and a polymeric overcoat which does not contain any image dye, the dye layer having an infrared-absorbing material associated therewith to absorb at a given wavelength of the laser used to expose the element, the image dye is substantially transparent in the infrared region of the electromagnetic spectrum and absorbs in the region of from about 300 to about 700 nm and does not have substantial absorption at the wavelength of the laser used to expose the element.

It has been found that a protective overcoat applied to the surface of the ablation sheet prior to laser writing allows the dye to be removed as well as improves the scratch-resistance and abrasion-resistance of the sheet. This is important, for example, in reprographic mask and printing mask applications where a scratch can remove fine line detail creating a defect in all subsequently exposed work. The dye removal process can be either continuous (photographic-like) or half-tone. For purposes of this invention, monocolor refers to any single dye or dye mixture used to produce a single stimulus color. The resulting single-sheet medium can be used for creating medical images, reprographic masks, printing masks, etc., or it can be used in any application where a monocolored transmissions sheet is desired. The image obtained can be a positive or a negative image.

In a preferred embodiment of the invention, the ablative recording element contains a barrier layer between the support and the dye layer, such as those described and claimed in U.S. Ser. No. 099,970 of Topel et al., filed Jul. 30, 1993 and U.S. Ser. No. 259,586 of Pearce et al., filed Jun. 14, 1994, the disclosures of which are hereby incorporated by reference.

Another embodiment of the invention relates to a process of forming a single color, ablation image having an improved scratch resistance comprising imagewise heating by means of a laser, in the absence of a separate receiving element, the ablative recording element described above, the laser exposure taking place through the dye side of the element, and removing the ablated material, such as by means of an air stream, to obtain an image in the ablative recording element.

The invention is especially useful in making reprographic masks which are used in publishing and in the generation of printed circuit boards. The masks are placed over a photosensitive material, such as a printing plate, and exposed to a light source. The photosensitive material usually is activated only by certain wavelengths. For example, the photosensitive material can be a polymer which is crosslinked or hardened upon exposure to ultraviolet or blue light but is not affected by red or green light. For these photosensitive materials, the mask, which is used to block light during exposure, must absorb all wavelengths which activate the photosensitive material in the Dmax regions and absorb little in the Dmin regions. For printing plates, it is therefore important that the mask have high UV Dmax. If it does not do this, the printing plate would not be developable to give regions which take up ink and regions which do not.

As described above, the image dye in the dye ablative recording element is substantially transparent in the infrared region of the electromagnetic spectrum and absorbs in the region of from about 300 to about 700 nm and does not have substantial absorption at the wavelength of the laser used to expose the element. Thus, the image dye is a different material from the infrared-absorbing material used in the element to absorb the infrared radiation and provides visible and/or UV contrast at wavelengths other than the laser recording wavelengths.

Any polymeric material may be used as the overcoat or binder in the recording element of the invention. For example, there may be used cellulosic derivatives, e.g., cellulose nitrate, cellulose acetate hydrogen phthalate, cellulose acetate, cellulose acetate propionate, cellulose acetate butyrate, cellulose triacetate, a hydroxypropyl cellulose ether, an ethyl cellulose ether, etc., polycarbonates; polyurethanes; polyesters; poly(vinyl acetate); poly(vinyl halides) such as poly(vinyl chloride) and poly(vinyl chloride) copolymers; poly(vinyl ethers); maleic anhydride copolymers; polystyrene; poly(styrene-co-acrylonitrile); a polysulfone; a poly(phenylene oxide); a poly(ethylene oxide); a poly(vinyl alcohol-co-acetal) such as poly (vinyl acetal), poly (vinyl alcohol-co-butyral) or poly (vinyl benzal); or mixtures or copolymers thereof. The overcoat or binder may be used at a coverage of from about 0.1 to about 5 g/m$^2$.

In a preferred embodiment, the polymeric overcoat may be a polyurethane, cellulose nitrate, cellulose acetate propionate, gelatin or a polyacrylate.

In a preferred embodiment, the polymeric binder used in the recording element employed in process of the invention has a polystyrene equivalent molecular weight of at least 100,000 as measured by size exclusion chromatography, as described in U.S. Pat. No. 5,330,876.

To obtain a laser-induced, ablative image using the process of the invention, a diode laser is preferably employed since it offers substantial advantages in terms of its small size, low cost, stability, reliability, ruggedness, and ease of modulation. In practice, before any laser can be used to heat an ablative recording element, the element must contain an infrared-absorbing material, such as pigments like carbon black, or cyanine infrared-absorbing dyes as described in U.S. Pat. No. 4,973,572, or other materials as described in the following U.S. Pat. Nos.: 4,948,777, 4,950,640, 4,950,639, 4,948,776, 4,948,778, 4,942,141, 4,952,552, 5,036,040, and 4,912,083, the disclosures of which are hereby incorporated by reference. The laser radiation is then absorbed into the dye layer and converted to heat by a molecular process known as internal conversion. Thus, the construction of a useful dye layer will depend not only on the hue, transferability and intensity of the dye, but also on the ability of the dye layer to absorb the radiation and convert it to heat. The infrared-absorbing material or dye may be contained in the dye layer itself or in a separate layer associated therewith, i.e., above or below the dye layer. As noted above, the laser exposure in the process of the invention takes place through the dye side of the ablative recording element, which enables this process to be a single-sheet process, i.e., a separate receiving element is not required.

Lasers which can be used in the invention are available commercially. There can be employed, for example, Laser Model SDL-2420-H2 from Spectra Diode Labs, or Laser Model SLD 304 V/W from Sony Corp.

Any dye can be used in the ablative recording element employed in the invention provided it can be ablated by the action of the laser and has the characteristics described above. Especially good results have been obtained with dyes such as anthraquinone dyes, e.g., Sumikaron Violet RS® (product of Sumitomo Chemical Co., Ltd.), Dianix Fast Violet 3R-FS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumikaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumiacryl Blue 6G® (product of Sumitomo Chemical Co., Ltd.), and Aizen Malachite Green® (product of Hodogaya Chemical Co., Ltd.);

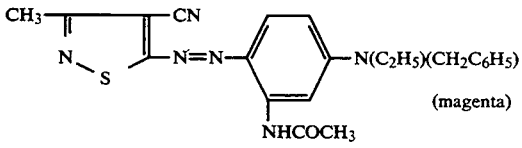

(magenta)

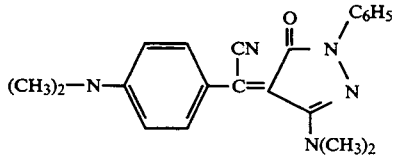

(magenta)

-continued

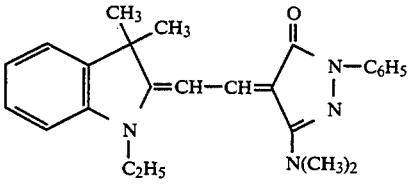

(yellow)

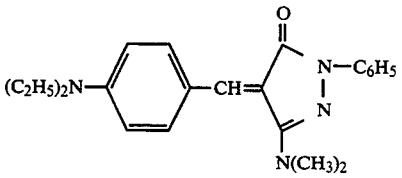

(yellow)

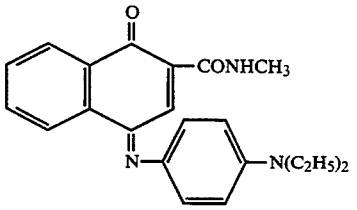

(cyan)

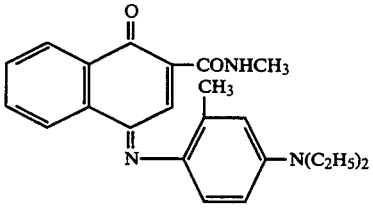

(cyan)

or any of the dyes disclosed in U.S. Pat. Nos. 4,541,830, 4,698,651, 4,695,287, 4,701,439, 4,757,046, 4,743,582, 4,769,360, and 4,753,922, the disclosures of which are hereby incorporated by reference. The above dyes may be employed singly or in combination. The dyes may be used at a coverage of from about 0.05 to about 1 g/m$^2$ and are preferably hydrophobic.

The dye layer of the ablative recording element employed in the invention may be coated on the support or printed thereon by a printing technique such as a gravure process.

Any material can be used as the support for the ablative recording element employed in the invention provided it is dimensionally stable and can withstand the heat of the laser. Such materials include polyesters such as poly(ethylene naphthalate); poly(ethylene terephthalate); polyamides; polycarbonates; cellulose esters such as cellulose acetate; fluorine polymers such as poly(vinylidene fluoride) or poly(tetrafluoroethylene-co-hexafluoropropylene); polyethers such as polyoxymethylene; polyacetals; polyolefins such as polystyrene, polyethylene, polypropylene or methylpentene polymers; and polyimides such as polyimide-amides and polyether-imides. The support generally has a thickness of from about 5 to about 200 μm. In a preferred embodiment, the support is transparent.

The following examples are provided to illustrate the invention.

EXAMPLE 1

The structural formulas of the dyes referred to below are:

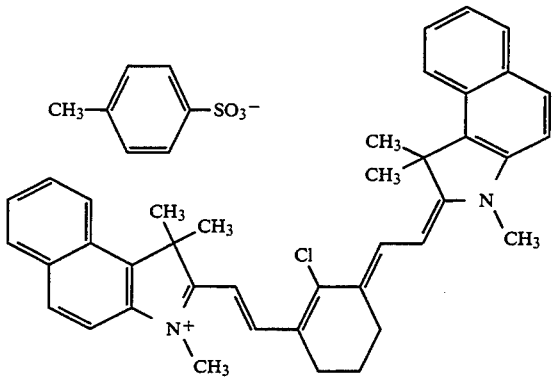

IR-1 IR-Absorbing Dye

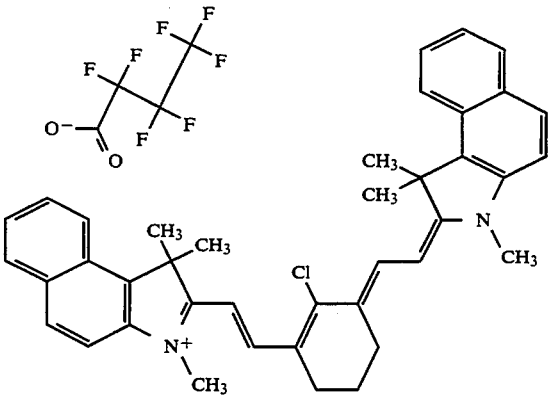

IR-2 IR-Absorbing Dye

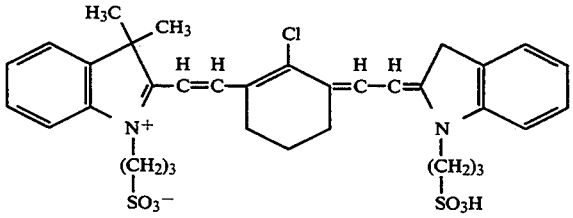

IR-3 IR-Absorbing Dye

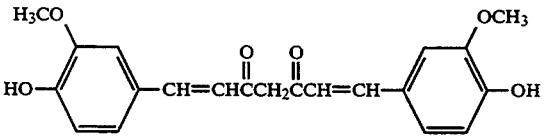

Y-1 Yellow Dye

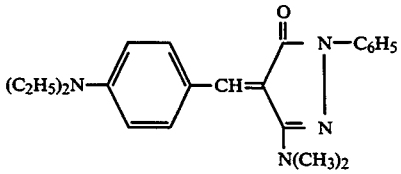

Y-2 Yellow Dye

-continued

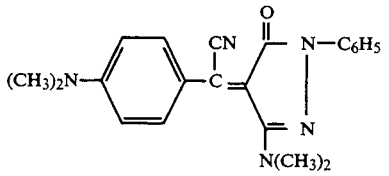

M-1 Magenta Dye

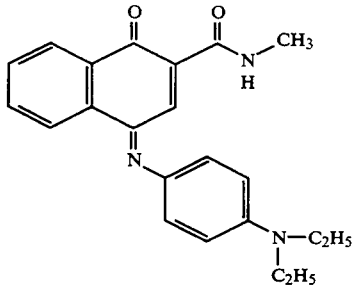

C-1 Cyan Dye

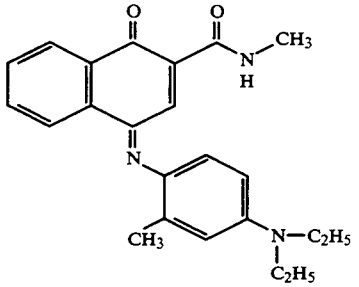

C-2 Cyan Dye

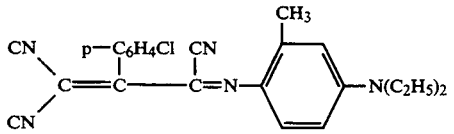

C-3 Cyan Dye

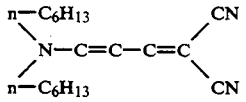

UV-1 UV-Absorbing Dye

Monocolor media sheets were prepared by coating on a 100 μm bare poly(ethylene terephthalate) support a layer composed of 0.60 g/m$^2$ cellulose nitrate (available from Aqualon Co.), 0.13 g/m$^2$ UV-1 ultraviolet-absorbing dye, 0.28 g/m$^2$ Y-1 yellow dye, 0.01 g/m$^2$ M-1 magnets dye, 0.16 g/m$^2$ C-3 cyan dye, and 0.22 g/m$^2$ IR-1 infrared-absorbing dye.

The following overcoat formulations were tested on individual samples of the above monocolor sheets:

| | |
|---|---|
| Control | no overcoat |
| Ex-1 | 0.11 g/m$^2$ Zar Aqua Gloss Polyurethane (available from United Gilsonite Labs.) with 0.02 g/m$^2$ 10 G surfactant (nonyl phenoxy polyglycidol from Olin Corp.); |
| Ex-2 | 0.11 g/m$^2$ poly(butyl acrylate/methacrylic acid) (30:70) copolymer; |
| Ex-3 | same as Ex-2, except that 0.11 g/m$^2$ IR-3 infrared-absorbing dye was added; |
| Ex-4 | same as Ex-3, except that 1,4-butanediol diglycidyl ether was added for crosslinking; |
| Ex-5 | 0.11 g/m$^2$ Minwax Polyacrylic Gloss (available from Minwax Co.) with 0.02 g/m$^2$ 10 G surfactant; |
| Ex-6 | 0.11 g/m$^2$ of a copolymer of methyl methacrylate with hydroxyethyl methacrylate and the sodium salt of 2-sulfoethyl methacrylate with 0.02 g/m$^2$ 10 G surfactant. |

An abrasion test was devised which consisted of placing 3 tablespoons of coarse silicon carbide (~100 grit) in a 1 quart (0.9 liter) can. Inside, along the side of the can, was taped a sample of the film to be tested facing the center of the can. The can was rotated at 60 RPM and the optical density of the film measured after 16 hours to detect any changes in the Dmax.

In addition, the samples were also ablation-written using a 1 mWatt laser with a wavelength range of 800–830 nm.

The drum, 70.4 cm in circumference, was rotated at 600 RPM and the imaging electronics were activated to provide 738.6 mJ/cm$^2$ exposure as cited in Table 1. The translation stage was incrementally advanced across the dye-ablation element by means of a lead screw turned by a microstepping motor, to give a center-to-center line distance of 100 μm (945 lines per centimeter, or 2400 lines per inch). An air stream was blown over the donor surface to remove the sublimed dye. The measured total power at the focal plane was 520 mWatt.

TABLE 1

| Example # | % Loss in Dmax | UV Dmin at 738.6 mJ/cm$^2$ |
|---|---|---|
| Control | 3.0 | 0.09 |
| Ex-1 | 1.3 | 0.10 |
| Ex-2 | 1.8 | 0.10 |
| Ex-3 | 1.5 | 0.10 |
| Ex-4 | 1.2 | 0.09 |
| Ex-5 | 0 | 0.10 |
| Ex-6 | 0 | 0.11 |

These results show that not only does the overcoat improve the abrasion resistance, but it does so with minimal impact on the resulting Dmin.

EXAMPLE 2

Monocolor media sheets were prepared by coating a 100 μm poly(ethylene terephthalate) support, which had been subbed with acrylonitrile-vinylidene chloride-acrylic acid copolymer, with an optional interlayer composed of 0.054 g/m$^2$ gelatin, 0.054 g/m$^2$ IR-3, and 0.01 g/m$^2$ of a 1:1:1 trimix surfactant blend of sodium t-octylphenoxy-ethanesulfonate, nonylphenoxypolyglycidol, and the tetraethylammonium salt of perfluoroctylsulfonate. This interlayer was overcoated with a layer containing 0.65 g/m$^2$ of 1130 sec cellulose nitrate (manufactured and distributed by Aqualon Co.), 0.18 g/m$^2$ UV-1, 0.19 g/m$^2$ Y-1, 0.17 g/m$^2$ Y-2, 0.15 g/m$^2$ C-1, 0.11 g/m$^2$ C-2, and 0.17 g/m$^2$ IR-2. The presence or absence of the optional interlayer in each sample is indicated in Table 2.

The following overcoat variations were coated on these monocolor media sheets:

| | |
|---|---|
| Control | no overcoat |
| Ex-8 | 0.22 g/m$^2$ of a segmented polyurethane with 55% composed of a hard segment consisting of bis(hydroxy- |

-continued

| | |
|---|---|
| | methyl)propionate and neopentyl glycol and 45% composed of a soft segment made up of poly(propylene glycol) and polydimethylsiloxane with 0.02 g/m$^2$ 10 G surfactant. |

The film samples were tested for abrasion resistance as in Example 1, except that the test was run for 7 hours. The results are shown in Table 2.

TABLE 2

| Example # | Interlayer | % Loss in Dmax |
|---|---|---|
| Control | Yes | 33 |
| Control | No | 21 |
| Ex-8 | Yes | 0 |
| Ex-8 | No | 0 |

Both the composition of the dye layer and the presence or absence of an interlayer impact the abrasion resistance, but the use of an overcoat significantly improves the performance in all cases.

EXAMPLE 3

Monocolor sheets were prepared by coating on the subbed support of Example 2 a layer composed of 0,054 g/m$^2$ and 0,054 g/m$^2$ of IR-1 with 0.02g/m$^2$ 10G surfactant followed by a layer containing 0.65 g/m$^2$ of 1139 sec cellulose nitrate (manufactured and distributed by Aqualon Co.), 0.18 g/m$^2$ UV-1, 0.19 g/m$^2$ Y-1, 0.17 g/m$^2$ Y-2, 0.15 g/m$^2$ C-1, 0.11 g/m$^2$ C-2, and 0.17 g/m$^2$ IR-2.

The following overcoat variations were coated on top of the above monocolor media sheets:

| | |
|---|---|
| Control-1 | no overcoat |
| Ex-A | 0.054 g/m$^2$ gelatin with 0.054 g/m$^2$ IR-3 and 0.02 g/m$^2$ 10 G surfactant |
| Ex-B | like Ex-A, except that the gelatin laydown was 0.108 g/m$^2$ |
| Ex-C | like Ex-B except bis(vinylsulfonylmethane) was used for crosslinking |
| Ex-D | like Ex-A except that a layer of 1.08 g/m$^2$ of cellulose nitrate was overcoated on the gelatin layer |
| Ex-E | 0.22 g/m$^2$ cellulose acetate propionate (Eastman Chemical Co.) with 0.054 g/m$^2$ IR-2 |
| Ex-F | 1.08 g/m$^2$ cellulose nitrate with 0.054 g/m$^2$ IR-2 |
| Ex-G | same as Ex-1 of Example 2 above |
| Ex-H | 0.13 g/m$^2$ AQ 55 (an aqueous dispersible polyester available from Eastman Chemical Co.) with 0.027 g/m$^2$ IR-3 and 0.02 g/m$^2$ 10 G surfactant. |

A more severe scratch and abrasion test was performed on a practical in-house built apparatus which consisted of a stepping motor, a 2.25" by 2.39" 320 grit piece of sandpaper attached to the bottom of a 62 gram weight on an inclined surface of 57 degrees. The stepper motor dragged the weighted sandpaper 20 times up and down the film. The yellow optical density (OD) change was measured on a Model 3-OT Status A X-Rite (by X-Rite Co.) densitometer and also reported in Table 3 below.

In addition, the images were laser-ablated as in Example 1 except that 250 mWatt lasers were used with an average power at the focal plane of 90 mWatt. The 53 cm drum was rotated at 200 RPM to give an energy of 508.5 mJ/cm$^2$. The resulting Dmin densities are included in Table 3.

TABLE 3

| Example # | Status A Blue Dmin | Loss in Dmax Density |
|---|---|---|
| Control-1 | 0.10 | 2.8 |
| Ex-A | 0.15 | 2.4 |
| Ex-B | 0.15 | 1.7 |
| Ex-C | 0.14 | 1.6 |
| Ex-D | 0.22 | 2.3 |
| Ex-E | 0.12 | 2.2 |
| Ex-F | 0.15 | 2.2 |
| Ex-G | not measured | 1.5 |
| Ex-H | 0.30 | 2.5 |

These results show that a variety of scratch- and abrasion-resistant overcoats reduced the wear without grossly increasing the Dmin achieved.

EXAMPLE 4

Monocolor media sheets were prepared by coating 100 μm bare poly(ethylene terephthalate) support with an imageable layer containing 0.97 g/m$^2$ of 1000 sec cellulose nitrate (manufactured and distributed by Aqualon Co.), 0.097 g/m$^2$ of UV-1, 0.26 g/m$^2$ of Y-1, 0,012 g/m$^2$ of M-1, 0.0.16 g/m$^2$ of C-3, and 0.30 g/m$^2$ of IR-1.

The following overcoat variations were coated on top of the above monocolor media sheets:

| | |
|---|---|
| Control | no overcoat |
| Ex-I | 0.11 g/m$^2$ of the segmented polyurethane described for Ex-1 in Example 2 and 0.01 g/m$^2$ of the trimix surfactant blend used for the interlayer of Example 2 |
| Ex-J | 0.11 g/m$^2$ Zar Aqua Gloss polyurethane with 0.01 g/m$^2$ of the trimix surfactant blend used for the interlayer of Example 2 |
| Ex-K | 0.22 g/m$^2$ 1000 sec cellulose nitrate with 0.01 g/m$^2$ DC 510 silicone oil (available from Dow Corning Corp.). |

The same abrasion test as described for Example 2 was run, and the results obtained are shown in Table 4 below.

TABLE 4

| Example # | Initial Dmax | After Abrasion Test Dmax | Change in OD |
|---|---|---|---|
| Control | 3.26 | 3.00 | −0.26 |
| Ex-I | 3.25 | 3.25 | 0.00 |
| Ex-J | 3.25 | 3.25 | 0.00 |
| Ex-K | 3.22 | 3.04 | −0.18 |

Once again a measurable improvement is noted even when the overcoat is the same composition as the dye binder. A more dramatic improvement is noted when an overcoat which has either a lower dye affinity or which can be thermally depolymerized is used.

The invention has been described in detail with particular reference to preferred embodiments thereof, but it will be understood that variations and modifications can be effected within the spirit and scope of the invention.

What is claimed is:

1. A laser dye-ablative recording element comprising a support having thereon, in order, a dye layer comprising an image dye dispersed in a polymeric binder and a polymeric overcoat which does not contain any image dye, said dye layer having an infrared-absorbing material associated therewith to absorb at a given wavelength of the laser used to expose said element, said image dye being substantially transparent in the infrared region of the electromagnetic spectrum and absorbing in the region of from about 300 to about 700 nm and not having substantial absorption at the wavelength of the laser used to expose the element, said overcoat layer being coated at about 0.1 to about 5 g/m$^2$ of element.

2. The element of claim 1 wherein said infrared-absorbing material is a dye.

3. The element of claim 1 wherein said infrared-absorbing material is contained in said dye layer.

4. The element of claim 1 wherein said support is transparent.

5. The element of claim 1 wherein a barrier layer is present between said support and said dye layer.

6. The element of claim 1 wherein said polymeric overcoat is a polyurethane, cellulose nitrate, cellulose acetate propionate, gelatin or a polyacrylate.

7. A process of forming a single color, ablation image having an improved scratch resistance comprising imagewise heating by means of a laser, in the absence of a separate receiving element, a dye-ablative recording element comprising a support having thereon, in order, a dye layer comprising an image dye dispersed in a polymeric binder and a polymeric overcoat which does not contain any image dye, said dye layer having an infrared-absorbing material associated therewith to absorb at a given wavelength of said laser used to expose said element, said image dye being substantially transparent in the infrared region of the electromagnetic spectrum and absorbing in the region of from about 300 to about 700 nm and not having substantial absorption at the wavelength of said laser used to expose said element, said laser exposure taking place through the dye side of said element, said overcoat layer being coated at about 0.1 to about 5 g/m$^2$ of element and removing the ablated material to obtain an image in said ablative recording element.

8. The process of claim 7 wherein said infrared-absorbing material is a dye.

9. The process of claim 7 wherein said infrared-absorbing material is contained in said dye layer.

10. The process of claim 7 wherein said support is transparent.

11. The process of claim 7 wherein a barrier layer is present between said support and said dye layer.

12. The process of claim 7 wherein said polymeric overcoat is a polyurethane, cellulose nitrate, cellulose acetate propionate, gelatin or a polyacrylate.

* * * * *